United States Patent [19]

Clarke et al.

[11] 4,074,957

[45] Feb. 21, 1978

[54] SCREW COMPRESSORS

[75] Inventors: Robert John Clarke, Longfield; Guy Francis Hundy, Gravesend, both of England; Bernard Zimmern, Neuilly, France

[73] Assignee: Monovis B. V., Amsterdam, Netherlands

[21] Appl. No.: 713,093

[22] Filed: Aug. 9, 1976

[30] Foreign Application Priority Data

Aug. 21, 1975 United Kingdom ..... 34749/75

[51] Int. Cl.[2] ..... F01C 1/08

[52] U.S. Cl. ..... 418/195; 418/159; 417/310

[58] Field of Search ..... 418/159, 195; 417/310, 417/440

[56] References Cited

U.S. PATENT DOCUMENTS

| | | | |
|---|---|---|---|
| 3,088,659 | 5/1963 | Nilsson et al. | 418/159 |
| 3,151,806 | 10/1964 | Whitfield | 418/159 |
| 3,224,662 | 12/1965 | Oldberg | 417/310 |
| 3,432,089 | 3/1969 | Schibbye | 417/310 |
| 3,804,564 | 4/1974 | Zimmern | 418/195 |
| 3,869,227 | 3/1975 | Kocher et al. | 418/159 |

*Primary Examiner*—C. J. Husar

*Attorney, Agent, or Firm*—Stephen J. Rudy

[57] ABSTRACT

A single screw, gate rotor machine in which compressible fluid is fed to the machine through a low pressure inlet and exhausts through a higher pressure outlet, in which an unloading valve is provided in the casing adjacent to the high pressure side of the gate rotor, or each gate rotor where there are two gate rotors.

1 Claim, 6 Drawing Figures

SCREW COMPRESSORS

Figure 1:
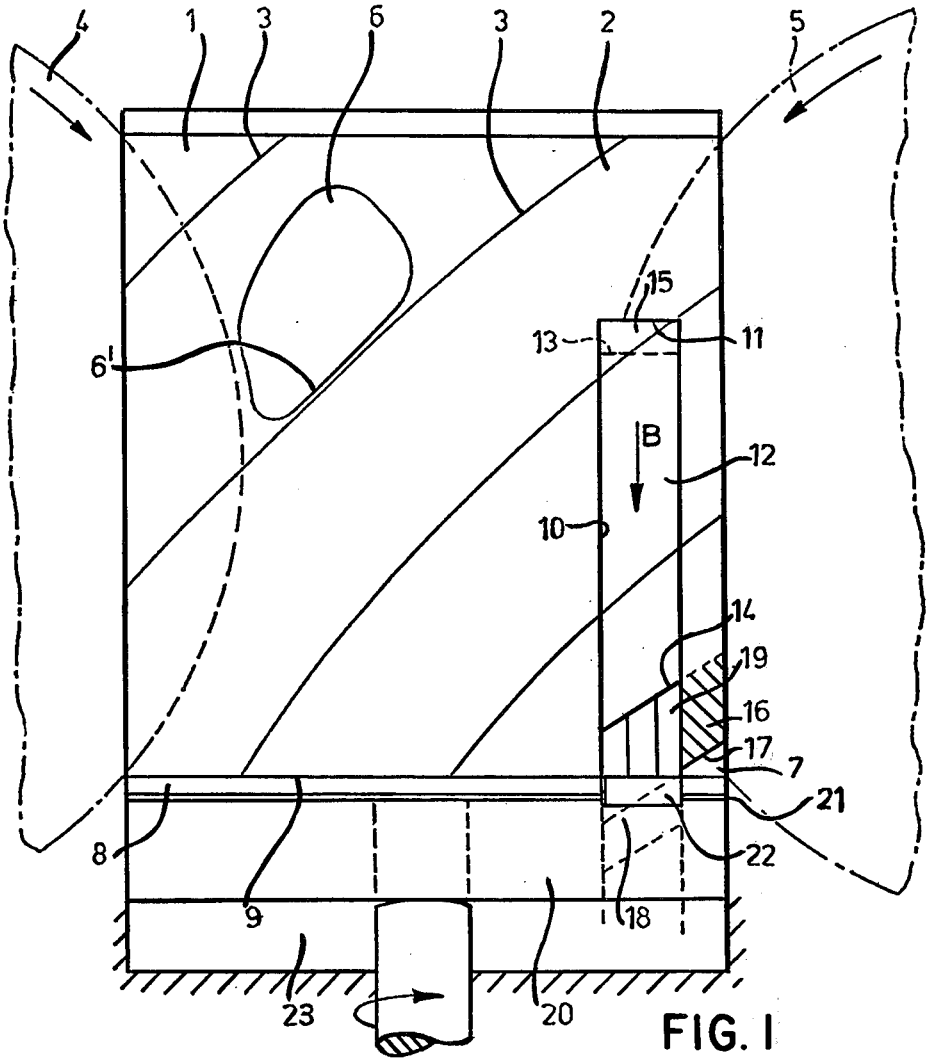

This invention relates to an improvement in a known kind of fluid working machine, notably a single screw, gate rotor machine which may be employed as a compressor, a motor or a pump.

Our prime interest is with regard to single screw, gate rotor machines when used as compressors (e.g. for compressing air or a refrigerant vapour or gas) and for simplicity, the following specification will refer to the mode of use in which compressible fluid is fed to the machine through a low pressure inlet port and is exhausted from the machine through a higher pressure outlet port. It should be appreciated, however, that it is believed that the invention applies equally to alternative modes of operation in which the machine is used to generate kinetic energy from a fluid supplied at high pressure (i.e. operation as a motor).

This invention is specifically concerned with fluid working machine of the kind comprising a screw rotatable about an axis and having surface grooves formed therein which are inclined relative to that axis, the lands, serving to separate the grooves one from another, making sealing engagement with a surrounding casing whereby each groove defines, during at least a part of the rotation of the screw, a chamber, at lease one gate rotor having teeth which intermesh with the grooves of the screw, each tooth being successively in sealing relationship with a groove as the intermeshing screw/-rotor(s) rotate, the volume of any chamber defined by a groove and limited by a rotor tooth changing from a maximum to a minimum as the screw and rotor(s) rotate, at least a high pressure port in the casing adjacent to a high pressure end of the screw and communicating with each chamber when the volume thereof is at, or adjacent to, its minimum volume and at least a low pressure port at a low pressure end of the screw. Throughout this specification, a fluid working machine of the kind just described, will be referred to as a "fluid working machine of the kind specified".

When a fluid working machine of the kind specified is used as a compressor, fluid to be compressed is supplied through the low pressure port. The geometry of the intermeshing screw and rotor together with the size of the high pressure port(s), would be selected to give a desired volume ratio (i.e. the ratio between the volume of the chamber when filled with fluid at the pressure existing in the low pressure port and when communication with that port has just ceased, to the volume of the chamber when that chamber first communicates with the high pressure port) but in many applications it is desirable to be able to modify the capacity of the machine (i.e. to modify the volume of gas compressed to the desired volume ratio per unit time) without altering (to any appreciable extent) the speed of rotation of the intermeshing screw/rotor(s) and without seriously modifying the designed volume ratio.

If the volume ratio is allowed to fall and the machine is working across a fixed pressure difference, the compression becomes inefficient resulting in reduced efficiency at part load. A rise in volume ratio is even less desirable because in addition to the power lost in over compressing the gas, the higher pressures occurring give rise to corresponding higher leakage losses.

To this end, it is known to provide a part of the casing with a movable valve element which allows modifications to be made to both the effective size of the low pressure port and the effective size of the high pressure port. In one known form of single screw gate rotor machine, the valve provided in the casing is located adjacent to the high pressure end of the screw and is adapted to move in a circumferential direction parallel to the direction of rotation of the screw. A valve disposed in this manner is restricted in its movement because when a certain percentage capacity reduction is reached, the high pressure end of the valve is virtually contacting the gate rotor. In one particular configuration of machine the known valve arrangement allows capacity reduction only in the range of 30%. In general a capacity reduction of this order is less than desirable in the case of compressors employed for refrigeration purposes, where a continuous capacity reduction down to at least 50% and preferably down to at least 30% full load is highly desirable (and in many cases essential).

We have now found that by the simple expedient of repositioning an unloading valve in the casing of a fluid working machine of the kind specified, it is possible to obtain dramatic increases in the permissable degree of unloading and, in an ideal case, it is possible to provide a machine having a facility for modifying the capacity continuously from 100% to 25% without unacceptable variations in volume ratio occurring throughout that adjustment range, and to capacities below 25% if a penalty of a reduced volume ratio can be accepted.

According to one aspect of the present invention in a fluid working machine of the kind specified there is additionally provided an unloading valve in the casing adjacent to the high pressure side of the or each gate rotor, said valve including a valve port which extends beyond the high pressure end of the screw, the port being provided with a movable closure member which in one limiting position obturates the one end of said valve port which is remote from the high pressure end of the screw while leaving a region of said valve port open at said high pressure end and in the other limiting position passes beyond the high pressure end of the screw and leaves open the valve port at the said one end.

The said one end of the valve port may extend substantially up to the point where each groove-defined chamber is first isolated from the low pressure port in the casing but we have found greater uniformity in volume ratio over the adjustable range of capacity that can be obtained by locating the said one end of the valve port at a point intermediate the low and high pressure ends of the screw.

The high pressure end of the closure member is conveniently shaped to correspond to the position of the leading land of a groove when it first communicates with the high pressure port.

In a two gate rotor single screw machine, two valve ports, each with its associated closure member, would normally be provided one valve port being located adjacent the high pressure side of each of the gate rotors.

In machines of this type, it is usual practice to provide injection of liquid into the groove-defined chambers for cooling, sealing, and lubrication. This liquid may be oil and/or the liquid phase of the vapour being compressed. A system in which the injected liquid is chemically identical to the vapour being compressed is disclosed in the specification of our British Pat. Nos. 1,356,298 and 1,352,699 and our patent application No. 53666/73.

Where the injected liquid is chemically identical to the vapour being compressed, or when the vapour being compressed dissolves in the oil to an appreciable extent, vapour is released if the liquid is injected into a region of low pressure. Consequently it is desirable to inject the liquid into a compression chamber which is sealed from the suction port and thus at an intermediate pressure. This minimises the volumetric loss.

By injecting the liquid via hole(s) in the closure member it is possible to maintain injection into chambers at intermediate pressure over a large capacity range. This is particularly useful where the injected liquid is fed to the hole(s) at delivery pressure (e.g. no liquid pump is employed) since then liquid cannot enter chambers when they are also at delivery pressure.

Figure 2:
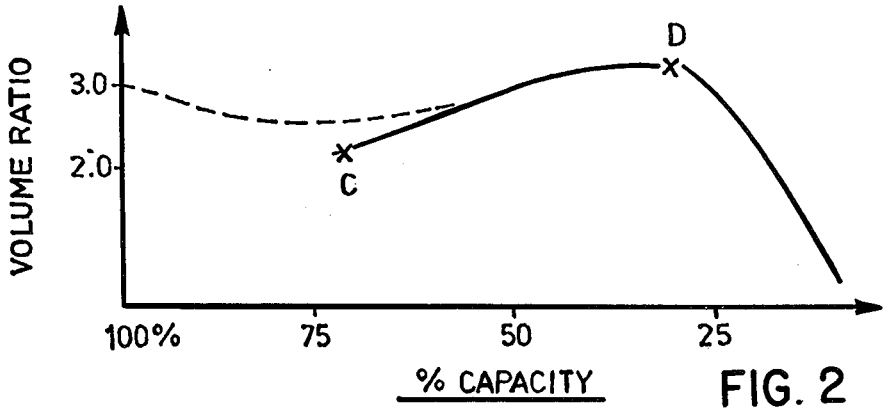
Figure 3:
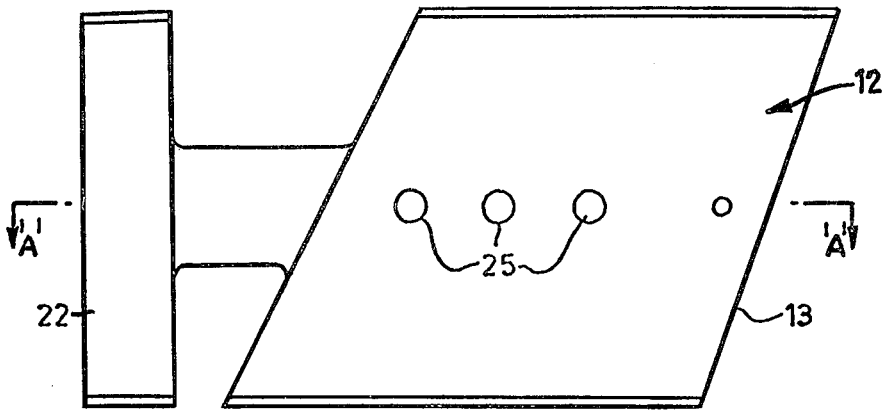
Figure 4:
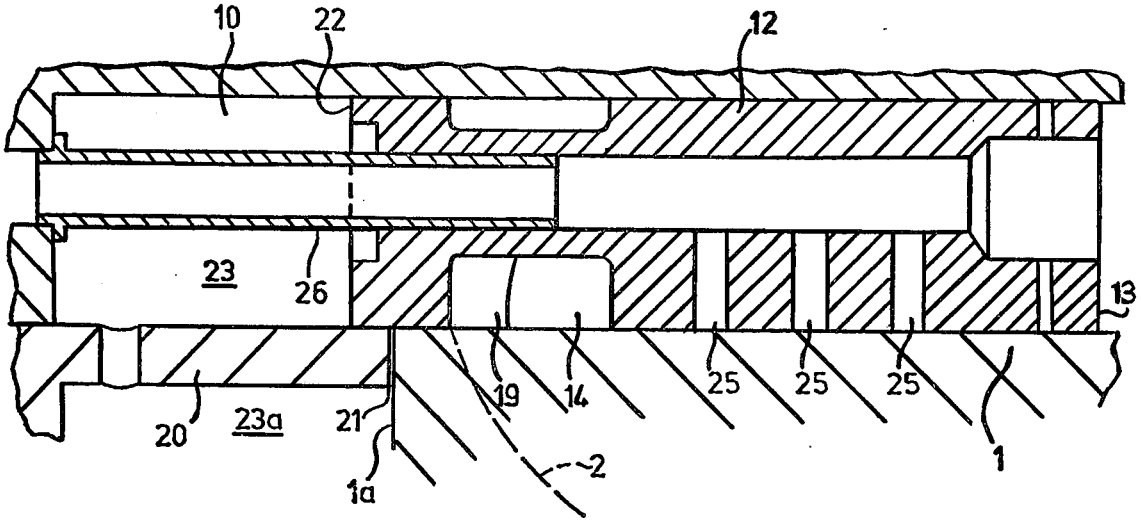
Figure 5:
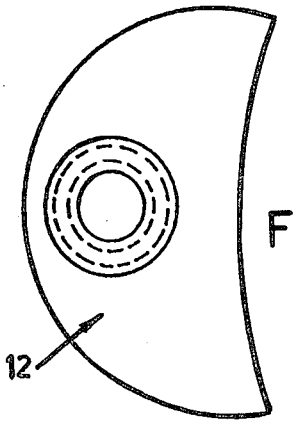
Figure 6:
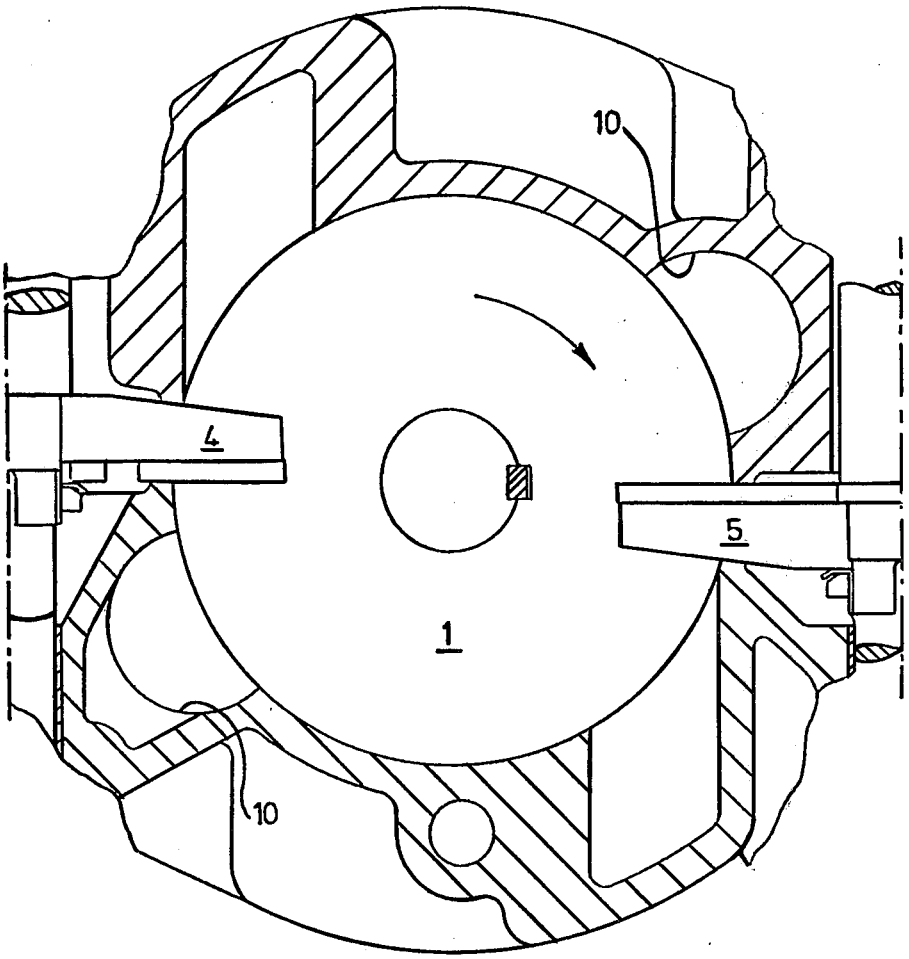

One embodiment of fluid working machine in accordance with the invention will now be described, by way of example, with reference to the accompanying schematic drawings, in which:

FIG. 1 is a purely schematic view of part of the machine showing the screw, two gate rotors and an unloading valve, FIG. 2 is a graphical representation of the performance of the machine shown in FIG. 1, FIG. 3 is a view of the moving part of the unloading valve, FIG. 4 is a section of the moving part of the unloading valve, shown in the full-load position, FIG. 5 is an end view of the moving part of the unloading valve, and FIG. 6 is a cross section of part of the machine, showing the main rotor, and two unloading valves.

Referring to FIGS. 1 and 6, there is shown a screw 1 having a generally circular cylindrical outer surface and provided with a plurality of helically inclined grooves 2 which are defined between lands 3, it being the radially outer surfaces of the lands which define the cylindrical shape of the screw 1. The screw 1 is in mesh with two gate rotors 4 and 5. These gate rotors are each provided with teeth (not shown) which locate in the grooves 2 and, as the screw 1 rotates in a cylindrical cavity in a surrounding casing (shown in FIG. 6), causes the volume of the grooves 2 defined between adjacent lands 3, the casing and the appropriate tooth of the gate rotor 4 or 5, to reduce from a maximum in which the groove is in contact with gas flowing through a low pressure inlet port 6 to a minimum when the gas compressed in the groove 2 is first released to a high pressure outlet port 7.

Single screw, gate rotor compressors of the kind described are sufficiently well known to make more detailed description of the mode of operation unnecessary.

The end of the screw 1 shown lowermost in FIG. 1, has an un-grooved narrow cylindrical high pressure end region 8 which is closely surrounded by the cylindrical casing. This means that each groove terminates approximately on the line 9, the teeth of each gate rotor ceasing to make contact with the screw 1 as each tooth moves through the plane normal to the rotating axis of the screw 1 that contains the line 9. This line 9 therefore represents the high pressure end of the screw.

To permit control to be exercised over the capacity of the compressor illustrated, the casing is provided with a valve port 10 which is disposed parallel to the axis of the screw 1 and extends from end 11 located (pressurewise) intermediate the low pressure port 6 and the high pressure port 7, beyond the line 9 and thus beyond the high pressure end of the screw 1. In the illustrated case the port 10 extends beyond the entire cylindrical region 8 but, it will be appreciated, this is not essential.

Slidably located in the port 10 is a closure member 12, the closure member having an end surface 13 which can make fluid-tight contact with the end 11 of the port 10. The member 12 defines a recess 19 limited in one direction by an end surface 14 of arcuate shape (the precise shape of the surface 14 being chosen to conform with the shape of the lands 2 in that region closest to the cylindrical region 8 of the screw 1) and limited in the opposite direction by a portion 22 which serves to prevent the passage of gas between the recess 19 and a low pressure region 23. Because the region 23 is maintained at a low pressure, (e.g. close to the suction pressure of the machine), the axial force on the closure member 12, due to gas pressure, is minimised.

FIG. 4 shows a preferred arrangement for effecting a seal at the high pressure end of the screw 1. This arrangement is described in greater detail in the specification of our co-pending application of even date but relies on a seal being provided in a clearance 21 formed between the end face 1*a* of the screw 1 and an end face 20*a* of a sealing ring 20 fixed with the casing.

The region 23*a* beyond the screw 1 is at low pressure (close to that of the region 23) so that the labyrinth or other seal provided in the clearance 21 holds back the delivery pressure of the machine. Locating the high pressure seal in the clearance has a number of advantages (discussed in the said specification) but in the case of a fluid working machine in accordance with this invention has a further advantage that the ports 10 can cross the cylindrical end region 8 without causing difficulties in the high pressure sealing arrangements, which difficulties would arise were the high pressure seal to be located in the conventional position between the cylindrical region 8 and the confronting casing part.

Let it be assumed that the closure member 12 is in its full-load position so that the end surface 13 is tight against the end 11 of the port 10. The compressor now works at full rated capacity. Each groove 2 becomes sealed off from the port 6 when its trailing land 3 just passes the edge 6' of the port 6 as shown in FIG. 1 and the fluid contained in the groove at that time is successively compressed until the leading land 3 of that groove passes beyond the end surface 14 of the closure member 12, at which time the compressed gas in the groove is released to the outlet port 7 (which includes the recess 19).

When it is desired to reduce the capacity of the machine, the closure member 12 is moved slightly in the direction of the arrow B to reveal a valve port 15 and at the same time to effect a reduction in the size of the outlet port 7 (the end surface 14 has also moved). The valve port 15 is in communication with the low pressure port 6 (via a duct formed in the casing-not shown) and its appearance means that an opportunity is given for fluid to escape from a groove (as the latter passes below the port 15) so that the total volume of fluid trapped in each groove, when the compression of that fluid starts or recommences, is reduced. If the screw were rotating very slowly, compression of fluid in any given groove above the pressure existing in the ports 6 and 15 would not commence until the trailing land 3 of that groove had passed the valve port 15. With very slow rotation of the screw 1 this condition would apply for almost any aperture size of the port 15 and the implication of this would be that any movement of the closure member 12 to reveal a port 15 would have an immediate step-wise effect on the capacity of the compressor. With a port 10 positioned as shown in FIG. 1 something of the order of a 30% reduction in capacity would immediately occur as soon as the end surface 13 moved away from the end 11 of the port 10.

In fact, this does not happen. Because the screw 1 is rotating quite rapidly and because the fluid has a finite viscosity, although there must be some "bleeding away" of fluid pressure from the groove underlying the port 15, this bleeding away does not result in a total loss of pressure, the actual pressure reduction depending on the size of the port 15 revealed by moving the closure member 12.

The wider the valve port 15 becomes, the smaller is the volume of the groove 2 before it is finally cut off from the low pressure existing in the ports 6 and 15. This has the effect of continually reducing the capacity of the compressor.

Were this the only effect of moving the closure member 12, the performance of the compressor would be generally unsatisfactory because the reduction in capacity would be paralleled by a reduction in the volume ratio (and thus a reduction in the pressure of the fluid in the groove 2 when it opens to the outlet port 7). However, as the end surface 13 moves away from the end 11 of the port 10, the end surface 14 of the closure member 12 moves closer to the high pressure end of the screw 1. Since it is the position of the end surface 14 which determines when a groove opens to the outlet port, moving the closure member 12 in the direction of the arrow B increasingly delays the point at which the compressed fluid in a groove is released to the high pressure port and, with an arrangement somewhat as illustrated, it is possible to obtain an approximately uniform volume ratio throughout an extensive range of compressor unloading. The region shaded and marked 16 in FIG. 1 has no effect on the volume ratio during initial movement of the closure member 12 but its edge 17 does control the moment of release of pressure from each groove when the closure member 12 has moved sufficiently far along the port 10 to place the end surface 14 beyond the position indicated by the dotted line 18 in FIG. 1. In the earlier stages of unloading, the region 16 merely acts to throttle the outflow of fluid from an uncovered groove but this is not of any real significance in practice.

Once the end surface 14 of the closure member 12 has passed beyond the dotted line 18, the end surface 14 is ineffective to modify volume ratio and there is therefore a marked falling off of volume ratio during the final stages of unloading.

The performance described is illustrated in FIG. 2 which plots volume ratio against percentage capacity for an unloading operation. The point C shown on the graph represents the point where there would be a sudden drop in percentage capacity on initial opening of the port 15, were it not for the viscosity effect already discussed. The viscosity effect prevents the sudden drop and gives rise to a performance represented by the dotted portion of the curve shown on the left hand side. The region from C to D represents the main unloading operation when the port 15 is increasing as the effective size of the high pressure port 7 is decreasing (i.e. the end surface 14 of the closure member 12 is effective in this range). The region to the right of D represents movement of the closure member 12 after the end surface 14 has passed through the dotted line 18 and no further change in size of the outlet port occurs.

The section of the closure member 12 shown in FIG. 4 represents a typical arrangement of liquid injection holes 25. The liquid enters the member 12 via a fixed tube 26, over which the closure member slides. The movement is towards the left in FIG. 4 as the capacity is reduced.

It is thus apparent that as the closure member moves to reduce the capacity of the machine, the injection points are maintained at a position between suction cut off, defined by the edge of the end surface 13 and the commencing of delivery, defined by the edge of the end surface 14. In the later stages of capacity reduction, the aperture 19 passes over the fixed surface 20 and the leading injection hole(s) may also pass beyond the end of the grooves and over the surface 20. This effectively cuts off the injection from these hole(s) and reduces the overall injection rate. The injection may also be progressively cut off by virtue of the other end of the holes 25, being covered by the tube 26 as the member 12 moves. Thus means are disclosed whereby the injection rate can be controlled, to some extent, as the capacity is reduced. Clearly use of angled holes and/or slots permits various characteristics to be selected at will.

Any convenient mechanism can be employed for moving the closure member 12. If the characteristics shown in FIG. 2 give too great a variation in volume ratio over the desired region of capacity adjustment, it is possible to utilise two or more closure members in each port 10 in order to arrange for dissimilar changes in the port size at the low and high pressure ends of the closure member. The valve port 15 has been shown rectangular in FIG. 1 but a practical shape could be non-rectangular, the end surface 13 and the end 11 of the port 10 sloping to conform to the pitch of the screw at that point. FIG. 3 shows a closure member having an end surface 13 of this shape.

Although not shown in FIG. 1 a second unloading valve will be provided in a diametrically opposed position to that shown (see FIG. 6) and will operate in conjunction with the grooves limited by the teeth of the gate rotor 4. The two unloading valves would normally be ganged together and operated in unison.

Although the specific description has featured a screw of circular cylindrical outer shape and flat gate rotors these are not to be considered as limitations of the invention, which is equally applicable to screws of conical or other outer configuration, and other types of gate rotor such as gate rotor where the teeth are disposed on a cylinder.

We claim:

1. Positive displacement rotary machine comprising a screw rotatable about an axis and having surface grooves formed therein which are inclined relative to that axis, the lands, serving to separate the grooves one from another, making sealing engagement with a surrounding casing whereby each groove defines, during at least a part of the rotation of the screw within the casing, a chamber, at least one gate rotor having teeth which intermesh with the grooves of the screw, each tooth being successively in sealing relationship with a groove as the intermeshing screw/rotor(s) rotate, the volume of any chamber defined by a groove and limited by a rotor tooth changing from a maximum to a minimum as the screw and rotor(s) rotate, at least a high pressure port in the casing adjacent to a high pressure end of the screw and communicating with each chamber when the volume thereof is at, or adjacent to, its minimum volume and at least a low pressure port at the low pressure end of the screw, characterized in that an unloading valve is disposed in the casing in spaced relation to the gaterotor in the high pressure side of said casing, said valve including a valve port which extends beyond the high pressure end of the screw, such high pressure end being in sealing contact with a radially extending portion of the casing, the port being provided with a movable closure member which in one limiting position obturates the one end of said valve port remote from the high pressure end of the screw while leaving a region of said valve port open at said high pressure end and connected to said high pressure port end, and in another limiting position passes beyond the high pressure end of the screw and leaves open the end of the valve port which is remote from the high pressure end of the screw and is connected by ducts to said low pressure port, said high pressure port in the casing being located between said unloading valve and said gaterotor.

* * * * *